US007699937B2

(12) United States Patent
Kim et al.

(10) Patent No.: US 7,699,937 B2
(45) Date of Patent: Apr. 20, 2010

(54) METHOD FOR CONTROLLING DISH WASHING MACHINE

(75) Inventors: Seong Ho Kim, Seoul (KR); Tae Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 254 days.

(21) Appl. No.: 11/882,120

(22) Filed: Jul. 30, 2007

(65) Prior Publication Data

US 2008/0236623 A1 Oct. 2, 2008

(30) Foreign Application Priority Data

Mar. 31, 2007 (KR) ..... 10-2007-0032116

(51) Int. Cl.
*B08B 9/20* (2006.01)

(52) U.S. Cl. ..... 134/18; 134/25.2; 134/34; 134/26

(58) Field of Classification Search ..... None
See application file for complete search history.

(56) References Cited

U.S. PATENT DOCUMENTS

2006/0010937 A1* 1/2006 Kim et al. ..... 68/12.05

FOREIGN PATENT DOCUMENTS

| | | | |
|---|---|---|---|
| EP | 1759622 | A2 | 3/2007 |
| GB | 775975 | A | 5/1957 |
| JP | 2006-314667 | A | 11/2006 |
| WO | WO 2006/037447 | A1 | 4/2006 |

* cited by examiner

*Primary Examiner*—Michael Kornakov
*Assistant Examiner*—Ryan Coleman
(74) *Attorney, Agent, or Firm*—McKenna Long & Aldridge LLP

(57) ABSTRACT

A method for controlling a dish washing machine is disclosed. The disclosed method includes turning off a heater of a steam generator when a water level sensor for the steam generator indicates a minimum water level, supplying water to the steam generator for a first time, to remove air bubbles around the water level sensor, and counting the number of repetition times of the water supplying step when the water level sensor still indicates the minimum water level after the execution of the water supplying step, and again executing the water supplying step, based on the counted value.

7 Claims, 4 Drawing Sheets

METHOD FOR CONTROLLING DISH WASHING MACHINE

This application claims the benefit of Korean Patent Application No. 10-2007-0032116, filed on Mar. 31, 2007, which is hereby incorporated by reference as if fully set forth herein.

BACKGROUND

1. Field of the Disclosure

The disclosure relates to a method for controlling a home appliance, and more particularly to a method for controlling a dish washing machine, which enables the dish washing machine to more efficiently wash dishes.

2. Discussion of the Related Art

Generally, dish washing machines are known as an apparatus for automatically washing dishes disposed in a washing compartment by spraying wash water toward the dishes under high pressure, and thus, removing foreign matter such as food residues attached to the surfaces of the dishes.

One of the important factors associated with such a dish washing machine is washability for cleanly removing food residues attached to the surfaces of dishes. In order to achieve an enhancement in washability, it is necessary to increase the force required to remove foreign matter from the surfaces of dishes, namely, the spray pressure of wash water. However, when the spray pressure of the wash water is excessively high, the dishes may be damaged or may easily be broken. Furthermore, when the washing of dishes is carried out at an increased spray pressure, the amount of wash water required in this washing operation is increased.

In addition, when wash water of an increased spray pressure is used, it is necessary to increase the power consumption of a pump used to supply the wash water.

SUMMARY

Accordingly, a dish washing machine that substantially obviates one or more problems due to limitations and disadvantages of the related art is highly desirable.

In order to achieve an enhancement in the washability of a dish washing machine without the damage of dishes, the use of steam is introduced into the dish washing machine as described herein in accordance with embodiments of the invention. The steam functions to soak foreign matter attached to dishes in water, and thus achieves an enhancement in washability even when wash water is sprayed onto the dishes at a more or less low pressure.

In order to supply steam, a steam generator equipped with a heater may be mounted to the dish washing machine. Water may be supplied to the steam generator several times because a supply of steam from the steam generator may be required several times for generally predetermined periods of time during operation of the dish washing machine.

Accordingly, a method for controlling a dish washing machine, which efficiently supplies water to the steam generator of the dish washing machine, is highly desirable.

Advantages and features will be set forth in part in the description that follows and in part will become apparent to those having ordinary skill in the art upon examination of the following or may be learned from practice of the invention. The aforementioned advantages and features may be realized and attained by the exemplary structures and/or methods particularly pointed out in the written description, claims, and the appended drawings.

The advantages may be achieved by a method for controlling a dish washing machine having a steam generator that comprises: turning off a heater of a steam generator when a water level sensor for the steam generator indicates a minimum water level; supplying water to the steam generator for a predetermined first time period, to remove air bubbles around the water level sensor; and counting a number of repetitions of the water supplying step that occurred following the turning off of the heater if the water level sensor still indicates the minimum water level after the execution of the water supplying step, and repeating the water supplying step, based on the determined number of repetitions.

The method may further comprise executing a waiting step for a second time period, following the water-supplying step.

The method may further comprise disabling operation of the steam generator if the number of repetitions is greater than or equal to a predetermined value.

The method may further comprise stopping the supply of water to the steam generator if the number of repetitions is greater than or equal to a predetermined value.

The method may further comprise disabling operation of the steam generator if a total water supply time is greater than or equal to a third time period, wherein the total water supply time is the time which water is supplied to remove the air bubbles, corresponds to a third time.

The method may further comprise disabling operation of the steam generator when a third time period elapses after the supply of water to the steam generator begins, following the turning-off of the heater.

When the water level sensor indicates both the minimum water level and a maximum water level, it may be determined that the minimum water level is maintained.

The advantages may also be achieved by a method for controlling a dish washing machine having a steam generator that comprises: turning off a heater of the steam generator when a water level sensor for the steam generator indicates a minimum water level; sensing a water level of the steam generator while supplying water to the steam generator for a predetermined time period; and stopping the supply of water and stopping an operation of the steam generator, when it is indicated that the water level sensor indicates a minimum water level after the predetermined time has elapsed.

When the water level sensor indicates both the minimum water level and a maximum water level, it may be determined that the minimum water level is maintained.

The method may further comprise enabling operation of the steam generator as carried out before the turning-off of the heater, when the water level sensor indicates that the water level of the steam generator higher than the minimum water level.

The method may further comprise executing, as scheduled, operations of the dish washing machine other than operation of the steam generator, which were operated simultaneously or alternately with the steam generator before the turning-off of the heater, even when the operation of the steam generator is stopped. In one embodiment, a dish washing machine, may include a tub defining a washing compartment, a sump to hold water, the sump coupled to the tub, a water supply tube coupled to the tub, a steam generator having an output coupled to the washing compartment and an input coupled to the water supply tube via an electrically controlled valve, an electrically controlled heater to convert water to steam, a water level sensor coupled to the steam generator to indicate a water level within the steam generator, a controller in communication with the valve, the heater, and the water level sensor, and a memory. The memory may include a set of instructions to cause the controller to turn off the heater of the steam generator when the water level sensor of the steam generator indicates a minimum water level, open the valve to supply water to the steam generator and close the valve after a predetermined first time period, determine a number of repetitions of opening and closing the valve that occurred following the turning off of the heater if the water level sensor indicates the minimum water level, and repeat the opening and closing of the valve, based on the determined number of repetitions.

In an embodiment, the heater of the dish washing machine may be within the steam generator.

In an embodiment, a dish washing machine having a steam generator, may include a tub defining a washing compartment, a sump to hold water, the sump coupled to the tub, a steam generator to supply steam to the washing compartment, means for determining a water level within the steam generator, and means for supplying water to the steam generator for a predetermined time period.

The dish washing machine may further include means for determining whether the water level within the steam generator is sufficient to generate steam.

The dish washing machine may further include means for stopping a supply of water and disabling operation of the steam generator if the water level within the steam generator is insufficient to generate steam.

The steam generator of the dish washing machine may include a heater in the sump.

The steam generator of the dish washing machine may be external to the tub.

It is to be understood that both the foregoing general description and the following detailed description are exemplary and explanatory and should not be construed as limiting the scope of any claim.

BRIEF DESCRIPTION OF THE DRAWINGS

The accompanying drawings, which are included to provide a further understanding of the embodiments described herein are incorporated in and constitute a part of this application, illustrate embodiment(s) of the invention and together with the description serve to explain the principle of the invention. In the drawings.

DETAILED DESCRIPTION OF THE INVENTION

Figure 1:
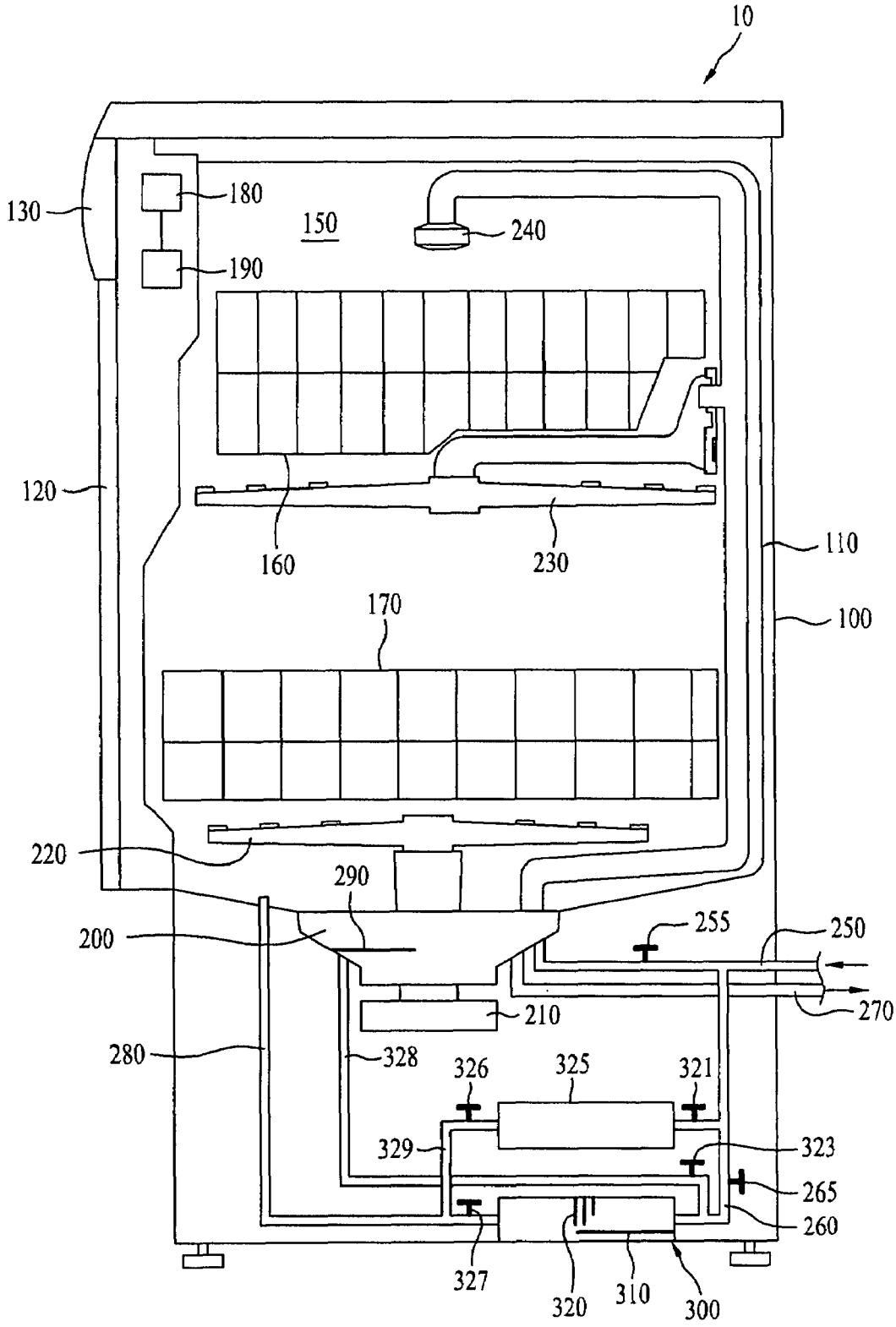
FIG. 1 is a schematic view illustrating a dish washing machine according to an embodiment of the present invention.

Reference will now be made in detail to the preferred embodiments, examples of which are illustrated in the accompanying drawings. Wherever possible, the same reference numbers will be used throughout the drawings to refer to the same or like parts.

The configuration of a dish washing machine, to which a control method according to an exemplary embodiment of the present invention is applied, will be described with reference to FIG. 1.

The dish washing machine 10 according to the illustrated embodiment of the present invention may include a case 100 defining the appearance of the dish washing machine, a door 120 for opening or closing the case 100, and a control panel 130 mounted to the case 100 or door 120, to enable the user to manipulate the dish washing machine.

A tub 110 may be arranged in the case 100, to define a washing compartment 150 in the case 100, as a space in which dishes are received and washed. A sump 200 for storing wash water may be arranged beneath the tub 110.

Arranged in the sump 200 may be a pump 210 for pumping the wash water stored in the sump 200 and a filter (not shown) for filtering contaminated wash water. A first heater 290 may also be arranged in the sump 200, to heat the wash water stored in the sump 200.

A first water supply tube 250 may be coupled to the sump 200, to supply fresh water from an external water supply source to the sump 200. A water discharge tube 270 is also connected to the sump 200, to externally discharge the wash water from the sump 200. A first water supply valve 255 for controlling the supply of water to the sump 200 may be arranged in series with the water supply tube 250.

At least one rack may be arranged in the interior of the tub 110, namely, the washing compartment 150. At least one spray arm may also be arranged in the washing compartment 150, to spray the water pumped by the pump 210 toward the at least one rack.

For reference, FIG. 1 illustrates an example in which an upper rack 160 and a lower rack 170 are arranged at upper and lower portions of the washing compartment 150, respectively, and an upper spray arm 230 and a lower spray arm 220 are arranged such that they spray water pumped by the pump 210 toward the upper rack 160 and lower rack 170, respectively.

In addition, a top nozzle 240 may be arranged at a top portion of the washing compartment 150. The top nozzle 240 functions to downwardly spray water pumped by the pump 210 from the top portion of the washing compartment 150.

The dish washing machine 10 according to one illustrated embodiment of the present invention may be configured to not only spray wash water into the washing compartment 150 by the pump 210 and spray arms 220 and 230, but also to spray or supply steam to the washing compartment 150. To this end, the dish washing machine includes a steam generator 300 which operates independently of the first heater 290 arranged in the sump 200.

As shown in FIG. 1, the steam generator 300 may communicate with the first water supply tube 250 via a second water supply tube 260. The steam generator 300 may also communicate with the washing compartment 150 of the tub 110 via a steam supply tube 280. A second water supply valve 265 for controlling the supply of water to the steam generator 300 may be arranged in series with the second water supply tube 260.

The steam generator 300 may include a second heater 310 for heating water supplied to the steam generator 300, and a water level sensor 320 for sensing the water level of the steam generator 300. The water level sensor 320 may provide water level indication values in either a digital or analog format. The water level sensor 320 may indicate, for example, a minimum water level and a maximum water level.

The minimum water level may be set to protect the second heater 310 of the steam generator 300. On the other hand, the maximum water level may be set to prevent the water supplied to the steam generator 300 from overflowing the steam generator 300.

In order to supply steam from the steam generator 300 at a desired time, a steam supply valve 327 for controlling opening or closing of the steam supply tube 280 may be installed in the steam generator 300.

The steam generator 300 may be connected to the sump 200 via an auxiliary water supply tube 328. In detail, the steam generator 300 may generate steam by heating wash water received via the sump 200. Of course, an auxiliary valve 323 may be arranged in series with the auxiliary water supply tube, in order to control the supply of water between the sump 200 and the steam generator 300.

A controller 180 may be provided to control the dish washing machine 10. As known in the art, the controller 180 may be in communication with a memory 190 that may store instructions used by the controller 180 to execute the steps of the methods in accordance with embodiments of the invention. The controller 180 may be electrically coupled to electrically-operated elements, for example, the control panel 130, the pump 210, and the steam generator 300, to control the operation of the dish washing machine 10. These operational couplings are not illustrated in FIG. 1, to avoid clutter in the figure.

Figure 2:
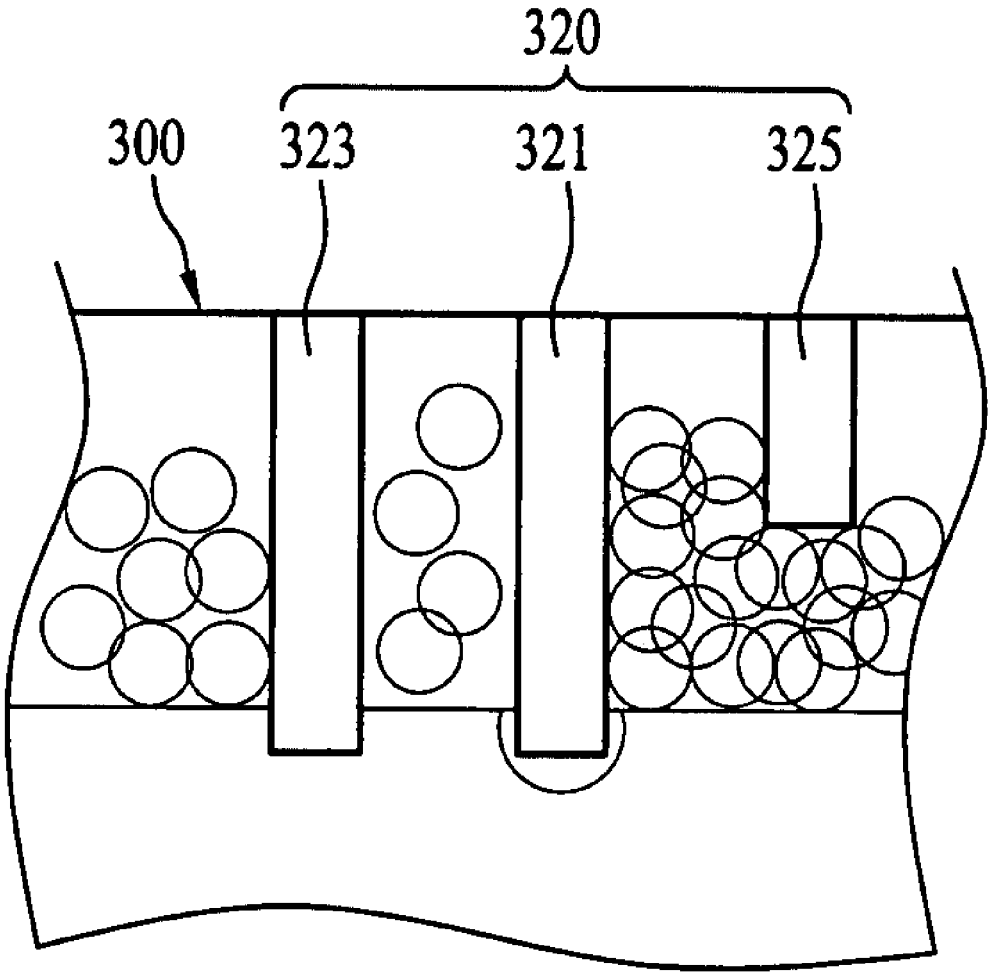
FIG. 2 is a schematic view illustrating the influence on a water level sensor caused by air bubbles generated in a stem generator.

In order to measure and indicate both the minimum and maximum water levels, the water level sensor 320 of the steam generator 300 may include a plurality of sensors, such as the electrode sensors shown in FIG. 2. For example, the water level sensor 320 may include a common electrode 321, a first electrode 323 having a first length, and a second electrode 325 having a second length, smaller than the first length. The electrode sensors may be arranged to be spaced apart from one another and to extend downwardly from the top of the steam generator 300.

In the exemplary embodiment, when the level of water in the steam generator 300 decreases below the lower ends of the common electrode 321 and first electrode 323, the common electrode 321 and first electrode 323 are electrically disconnected. In this state, the controller 180 may determine if the water level of the steam generator 300 corresponds to the minimum water level.

On the other hand, when the water level of the steam generator 300 increases above the lower ends of the common electrode 321 and first electrode 323 from the above-described minimum water level, the lower ends of the common electrode 321 and first electrode 323 are submerged under water, so that the common electrode 321 and first electrode 323 are electrically connected. In this state, the controller 180 may determine that the water level of the steam generator 300 corresponds to a water level higher than the minimum water level, namely, a normal water level.

When the water level of the steam generator 300 further increases such that even the lower end of the second electrode 325 is submerged under water, the common electrode 321 and second electrode 325 are electrically connected. In this state, the controller 180 may determine that the water level of the steam generator 300 corresponds to the maximum water level.

Meanwhile, after the dish washing machine 10 is used for a prolonged period of time, lime components contained in water are deposited in the steam generator 300 and the second water supply tube 260 connected to the steam generator 300. The deposited lime components generate air bubbles when water is supplied to the steam generator 300, as shown in FIG. 2. The generated air bubbles may prevent the water level sensor 320 from accurately measuring the water level, and thus cause a malfunction of the steam generator 300.

This will be described in more detail. For example, although the water level of the steam generator 300 corresponds to the normal water level, the air bubbles may interfere with the electrical connection between the common electrode 321 and the first electrode 323, thereby causing the water level sensor 320 to erroneously indicate that the water level of the steam generator 300 corresponds to the minimum water level. Also, although the water level of the steam generator 300 does not correspond to the maximum water level, the air bubbles may electrically connect the common electrode 321 and the second electrode 325, thereby causing the water level sensor 320 to erroneously indicate that the water level of the steam generator 300 corresponds to the maximum water level.

When the water level sensor 320 erroneously indicate the water level of the steam generator 300 due to the air bubbles generated in the steam generator 300, it may become difficult, or in some cases impossible, to efficiently supply an accurate amount of water to the steam generator 300 for efficient operation of the steam generator 300.

For example, when the normal water level of the steam generator 300 is erroneously indicated to be the minimum water level, an excessive amount of water is supplied, so that the supplied water may overflow the steam generator 300, or the time and energy taken to generate steam may be excessive. On the other hand, when the water level of the steam generator 300 does not correspond to the maximum water level, but is erroneously indicated to be the maximum water level, no supply of water is carried out even when the supply of water is required. In this case, the heater 310 may be exposed above the surface of the water, so that it may be overheated.

Figure 3:
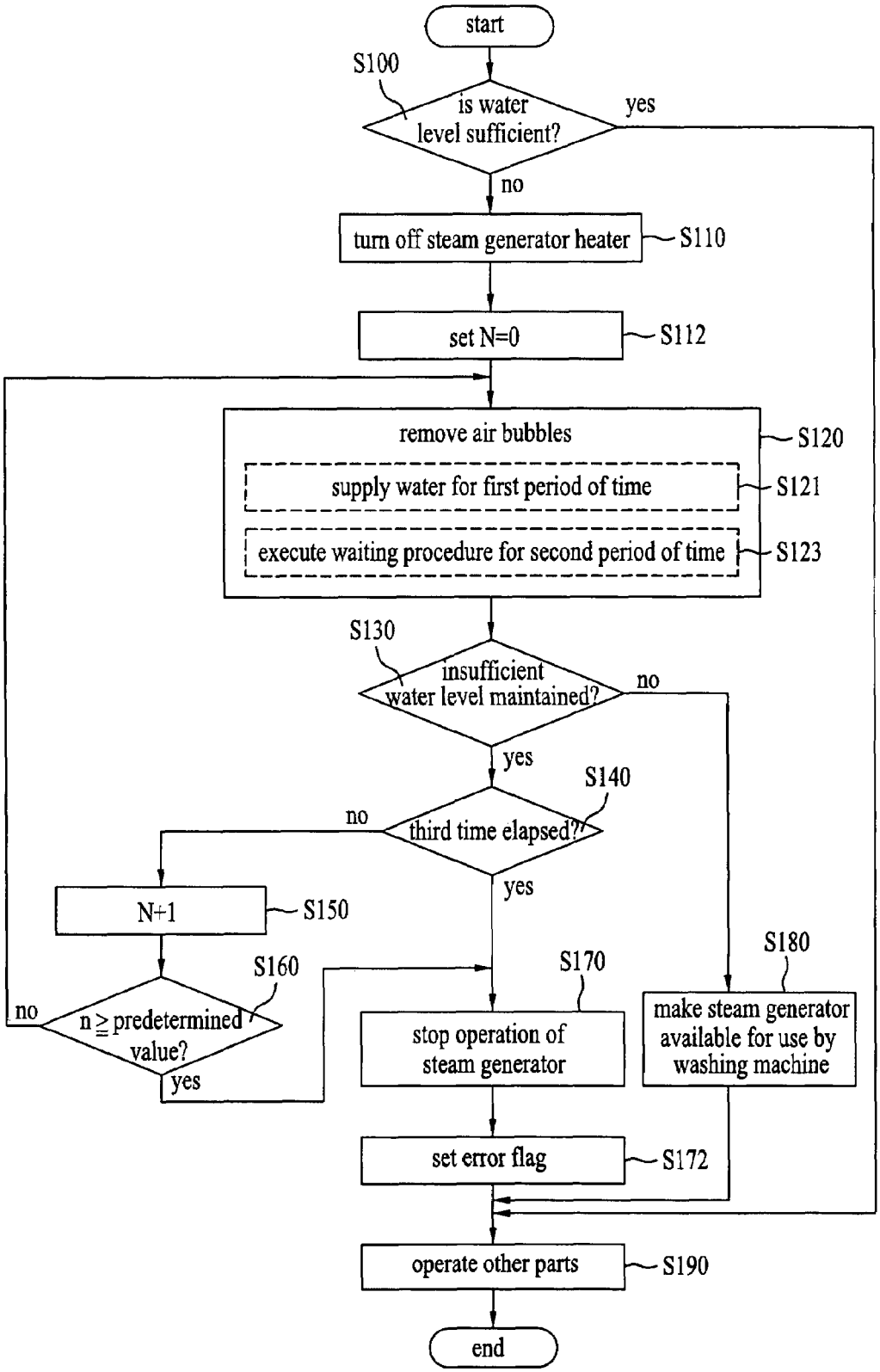
FIG. 3 is a flow chart illustrating a method for controlling the dish washing machine in accordance with a first embodiment of the present invention.
Figure 4:
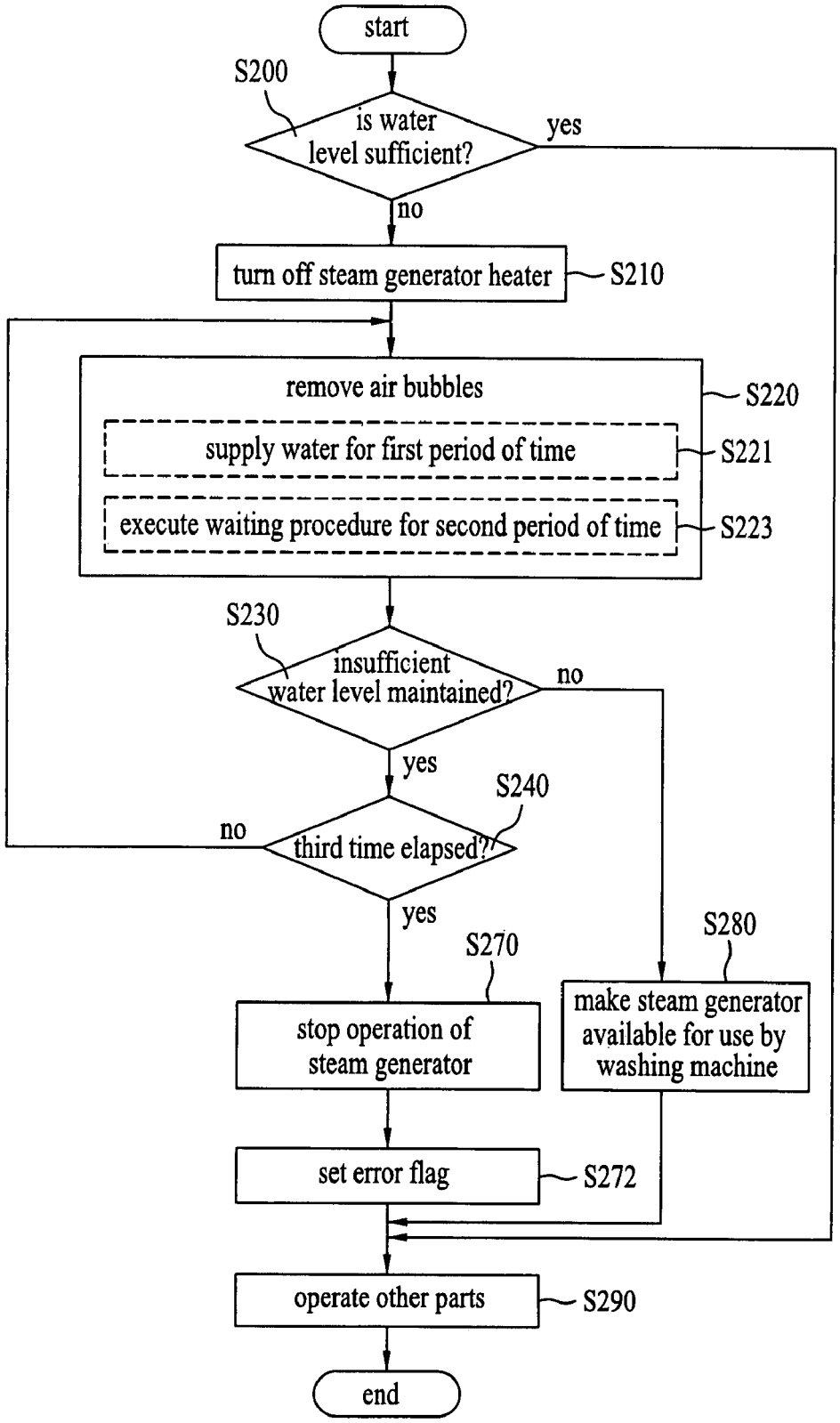
FIG. 4 is a flow chart illustrating a method for controlling the dish washing machine in accordance with a second embodiment of the present invention.

There is provided a method for solving the problems occurring due to the erroneous water level sensing of the water level sensor 320 caused by air bubbles. In FIGS. 3 and 4, methods according to the present invention are illustrated. The illustrated methods will be described in more detail with reference to the figures.

A method for controlling the dish washing machine 10 in accordance with the present invention includes turning off the heater of the steam generator when the water level sensor of the steam generator measures and indicates the minimum water level, supplying water to the steam generator, re-measuring and re-indicating the level of water in the steam generator, and determining whether or not the operation of the steam generator is to be continued, based on the re-indicated water level.

When the water level indicated at the water level re-measuring and re-indicating step is the minimum water level, the water-supplying step and the water level re-measuring and re-indicating step are repeatedly executed. When the number of repetitions, following turning off the heater, of the water-supplying step and the water level re-measuring and re-indicating step corresponds to a predetermined value, the operation of the steam generator may be disabled. By way of example, in one embodiment, when the operation of the steam generator is disabled, the controller 180 will not execute code to supply water to the steam generator 300 and will not execute code to turn on the heater 310.

Alternatively, when the water level indicated at the water level re-measuring and re-indicating step is the minimum water level, the heater may be turned off, and water may be supplied to the steam generator. In this case, after a predetermined time elapses from the supply of water, and the water level indicated remains at the minimum water level, the operation of the steam generator may be disabled.

As shown in FIG. 3, when the water level sensor 320 of the steam generator 300 indicates the low water level (S100) (i.e., the water level is insufficient), the controller 180 turns off the heater 310 (S110). This control operation is executed to protect the heater 310 when the level of water in the steam generator 300 actually corresponds to a level below the minimum level.

After the turn-off of the heater 310, a procedure for removing air bubbles may be executed (S120). In this procedure, water is first supplied to the steam generator 300 for a first predetermined time, for example, 7 seconds (S121). The supply of water to the steam generator may cause waves of water within the steam generator 300. As a result, air bubbles that may cause erroneous operation of the water level sensor 320 may be broken and thus removed, or are moved to other areas that do not interfere with the operation of the water level sensor 320.

After completion of the supply of water for the first predetermined time, a waiting procedure may be executed for a second predetermined time, for example, 3 seconds (S123), in order to allow the air bubbles that may cause erroneous operation of the water level sensor 320 to be sufficiently removed.

After the air bubble removing procedure S120 is executed for the predetermined time, for example, 10 seconds, the level of water in the steam generator 300 is checked using the water level sensor 320 (S130).

When it is indicated that the water level of the steam generator 300 is still maintained at the minimum water level, even after the second predetermined time elapses, namely, even after the air bubble removing procedure S120 is completed, this means that the air bubbles causing erroneous operation of the water level sensor 320 have been insufficiently removed, or the water level of the steam generator 300 has not been recovered to the normal water level in spite of the supply of water carried out for the first predetermined time. There is no or little possibility that the latter phenomenon occurs, because this phenomenon mainly occurs due to failure of the second water supply valve 265 or suspension of water supply. Accordingly, there is a high possibility that the above-described sensing result was caused by the former phenomenon.

On the other hand, in accordance with an embodiment of the invention, when the water level sensor 320 indicates both the minimum water level and the maximum water level, in the water level checking procedure S130, the controller 180 may be programmed to consider this event as a determination that the water level of the steam generator 300 is maintained at the minimum water level. This determination means that air bubbles present in the steam generator 300 have influence on the water level sensor 320, thereby causing the water level sensor 320 to operate erroneously. Thus, this determination is needed to additionally execute a required procedure for removing air bubbles.

When it is indicated that the water level of the steam generator 300 is still maintained at the minimum water level, even after the execution of the air bubble removing procedure S120, the number of execution times of the air bubble removing procedure S120 is incremented (S150). Prior to beginning the procedure, a counter may be set to a value of zero to record the number of execution times. Thereafter, it is determined whether or not the counted value reaches a predetermined value (S160). When the counted value does not reach the predetermined value, the air bubble removing procedure S120 including the water supplying procedure for the first predetermined time and optionally the waiting procedure for the second predetermined time may be repeated in accordance with a command from the controller 180.

When the number of repetition times of the air bubble removing procedure, namely, the counted value (e.g., counter value of N in FIG. 3), reaches the predetermined value, for example, 4, the supply of water to the steam generator 300 is stopped, and the operation of the steam generator 300 is disabled (S170), as shown in FIG. 3. An error flag may be set (S172) to identify the malfunction of the steam generator 300.

When the air bubble removing procedure S120 has been repeated several times, this means that a considerably large amount of water have been supplied to the steam generator 300. Accordingly, if it is indicated that the water level in the steam generator 300 is still maintained at the minimum water level, even after the repeated execution of the air bubble removing procedure S120 for the predetermined repetition times, there is a high possibility that the sensing result was caused by the failure of the second water supply valve 265 or water level sensor 320. Furthermore, when an excessive amount of water is supplied to the steam generator 300, the supplied water may overflow the steam generator 300. To this end, the repetition times of the air bubble removing procedure S120 may be limited to a predetermined value, such as the one described above.

On the other hand, it may be possible to determine whether or not there is a malfunction in the steam generator 300, while supplying water to the steam generator 300 after turning off the heater 310, based on the time elapsed after the supply of water to the steam generator 300 begins, without being based on the counted number of repetition times of the air bubble removing procedure S120, as in the above-described case in which the air bubble removing procedure S120 is repeated for predetermined repetition times.

In this case, a step of determining whether or not a third predetermined time has elapsed S140, after the execution of the air bubble removing procedure S120 and water level checking procedure S130 may be useful. For example, where the third predetermined time is set to 40 seconds, the controller 180 repeatedly executes the air bubble removing procedure S120 for, for example, 4 times as described above, namely, for 40 seconds, if the steam generator 300 is not recovered to the normal water level within 40 seconds, the method may proceed to S170.

At S170, when it is indicated that the water level in the steam generator 300 is still maintained at the minimum water level, even after 40 seconds have elapsed, the controller 180 may stop the repetition of the air bubble removing procedure S120, and disable operation of the steam generator 300 (S170).

Step S140 and steps S150 and S160 may be selectively applied in the method according to the present invention. Alternatively, both step S140 and steps S150 and S160 may be applied, in order to provide measures for compensation of count errors. FIG. 3 illustrates a method, in accordance with an embodiment of the invention, wherein both step S140 and steps S150 and S160 are applied. FIG. 4 illustrates a method, in accordance with an embodiment of the invention, wherein only step S140 is applied; steps S150 and S160 are not applied.

For reference, steps S200, S210, S230, S240, S270, S280, and S290 in FIG. 4 correspond to steps S100, S110, S130, S140, S170, S180, and S190, respectively. The air bubble removing procedure S120 in the embodiment of FIG. 3 may be different from the air bubble removing procedure S220 in the embodiment of FIG. 4. Each of the air bubble removing procedures S120 and S220 may include a step S121, S221 of supplying water for the first predetermined time and may also include a waiting step S123, S223 executed for the second predetermined time.

On the other hand, it may be possible to indicate, at step S140, a phenomenon that the supply of water for removal of air bubbles is executed for the third predetermined time exceeding the first predetermined time, due to errors in the second water supply valve 265, and to disable operation of the steam generator 300, based on the sensing of the above phenomenon.

This means that the supply of water continued for an excessively long period and may have been caused by the abnormal closing of the second water supply valve 265. In this case, accordingly, the operation of the steam generator 300 should be stopped. To this end, the controller 180 may execute code to perform a control operation to forcibly close the second water supply valve 265. Alternatively, the controller 180 may execute code to operate a separate valve (not shown) prepared against the failure of the second water supply valve 265, to cut off the supply of water to the steam generator 300, and may also execute code to disable operation of the steam generator 300.

The steam generator 300 may operate simultaneously or alternately with other parts of the dish washing machine 10 under the condition in which the heater 310 has not been turned off (i.e., normal operation). Even if, however, the operation of the steam generator 300 is forcibly stopped, due to, for example, the abnormal operation or inoperability of the steam generator 300, the operations of the other parts of the dish washing machine 10 may be carried out as scheduled.

For example, the spraying of water according to the operation of the pump 210 can be carried out as scheduled, irrespective of the stopping of the operation of the steam generator 300. The supply of steam is an auxiliary function to achieve an enhancement in washing performance. Accordingly, when there is a malfunction in the steam generator 300, the operation of the steam generator 300 is disabled, but the water-spraying and washing operations are maintained and may continue, to complete the scheduled dish washing course.

Meanwhile, even when the erroneous sensing of the minimum water level at step S100 was caused by air bubbles, the water level sensor 320 will subsequently indicate the water level of the steam generator 300 to be the normal water level, which is higher than the minimum water level, if the air bubbles have been sufficiently removed through the air bubble removing procedure S120 carried out for the first and second predetermined times.

On the other hand, when the minimum water level indicated at step S100 was correctly determined, the water level of the steam generator 300 will be recovered to the normal water level in accordance with the supply of water carried out for the first predetermined time. In this case, accordingly, the water level sensor 320 will subsequently indicate the water level of the steam generator 300 not to be the minimum water level, but to be a water level higher than the minimum water level, namely, the normal water level.

When it is indicated, after the air bubble removing procedure S120, that the water level of the steam generator 300 is a level higher than the minimum water level, the controller 180 turns on the heater 310, and continues the operation of the steam generator 300 carried out before the turning-off of the heater 310 (S180). In this case, the heater 310 may be turned on after waiting for a predetermined time in accordance with a set algorism, even when the normal water level is indicated.

Because steam is used in the dish washing procedure in accordance with the present invention, it is possible to achieve an enhancement in washability.

In accordance with the present invention, it is possible to efficiently supply water to the steam generator of the dish washing machine 10. Also, even when the water level sensor operates erroneously due to air bubbles generated during the supply of water to the steam generator, it is possible to normally operate the steam generator by use of the air bubble removing procedure. Accordingly, the reliability of the dish washing machine 10 is enhanced.

In accordance with the present invention, when there is a malfunction in the steam generator, this malfunction can be effectively identified, and the operation of the steam generator may be disabled in accordance with the sensing of the malfunction. Accordingly, it may be possible to avoid damage to the steam generator 300 caused by continued use of the malfunctioning steam generator.

In addition, in accordance with the present invention, even when the operation of the steam generator is stopped, a scheduled washing course can be completely achieved by maintaining the operations of other parts. Accordingly, even when the steam generator fails, the dish washing machine of the present invention can provide general dish washing services.

It will be apparent to those skilled in the art that various modifications and variations can be made from the embodiments described herein without departing from the spirit or scope of the invention. Thus, it is intended that the claims appended hereto cover the modifications and variations.

What is claimed is:

1. A method for controlling a dish washing machine having a steam generator, comprising:

turning off a heater of the steam generator when a water level sensor for the steam generator indicates a minimum water level;

removing air bubbles around the water level sensor by supplying water to the steam generator for a predetermined first time period;

counting a number of repetitions of the water supplying step that occurred following the turning off of the heater if the water level sensor indicates the minimum water level after the execution of the water supplying step; and repeating the water supplying step, based on the determined number of repetitions.

2. The method according to claim 1, further comprising:

executing a waiting step for a second time period, following the water supplying step.

3. The method according to claim 1, further comprising:

disabling operation of the steam generator, if the number of repetitions is greater than or equal to a predetermined value.

4. The method according to claim 3, further comprising:

stopping a supply of water to the steam generator if the number of repetitions is greater than or equal to a predetermined value.

5. The method according to claim 1, further comprising:

disabling operation of the steam generator if a total water supply time is greater than or equal to a third time period, wherein the total water supply time is the time which water is supplied to the steam generator following the turning off of the heater.

6. The method according to claim 1, further comprising:

disabling operation of the steam generator when a third time period elapses after the supply of water to the steam generator begins, following the turning-off of the heater.

7. The method according to claim 1, wherein, when the water level sensor indicates both the minimum water level and a maximum water level, it is determined that the minimum water level is maintained.

* * * * *